US005461877A

United States Patent [19]

Shaw et al.

[11] Patent Number: 5,461,877

[45] Date of Patent: Oct. 31, 1995

[54] AIR CONDITIONING FOR HUMID CLIMATES

[75] Inventors: Allan Shaw; Russell E. Luxton, both of Adelaide, Australia

[73] Assignee: Luminis Pty Ltd., Australia

[21] Appl. No.: 142,414

[22] PCT Filed: May 25, 1992

[86] PCT No.: PCT/AU92/00235

§ 371 Date: Jan. 24, 1994

§ 102(e) Date: Jan. 24, 1994

[87] PCT Pub. No.: WO92/20973

PCT Pub. Date: Nov. 26, 1992

[30] Foreign Application Priority Data

May 24, 1991 [AU] Australia ..... PK6304

[51] Int. Cl.[6] ..... F25D 17/06

[52] U.S. Cl. ..... 62/185; 62/176.6; 62/411; 62/436

[58] Field of Search ..... 62/185, 201, 176.1, 62/176.6, 434, 435, 436, 427, 410, 411, 412

[56] References Cited

U.S. PATENT DOCUMENTS

| | | | |
|---|---|---|---|
| 2,828,464 | 3/1958 | Nixon et al. | 323/67 |
| 4,319,461 | 3/1982 | Shaw | 62/93 |
| 4,457,357 | 7/1984 | Van Arnhem | 165/21 |
| 4,841,733 | 6/1989 | Dussault et al. | 62/93 |
| 4,876,858 | 10/1989 | Shaw et al. | 62/93 |
| 5,058,388 | 10/1991 | Shaw et al. | 62/93 |

FOREIGN PATENT DOCUMENTS

| | | | |
|---|---|---|---|
| 0040529 | 11/1981 | European Pat. Off. | F24F 11/08 |
| 0191007 | 8/1986 | European Pat. Off. | F24F 3/14 |
| 2852761 | 12/1978 | Germany | F24F 11/06 |
| 543715 | 10/1973 | Switzerland | F24F 3/14 |

*Primary Examiner*—Harry B. Tanner

*Attorney, Agent, or Firm*—Baker, Maxham, Jester & Meador

[57] ABSTRACT

An air conditioner with coolant pumped from a chiller first through a heat exchange conduit of an outside air heat exchanger to provide a minimum wetted surface temperature when treating undiluted outside air at its current temperature and humidity as it passes through this heat exchanger so to make maximum use of the available potential difference between the outside air and the coolant and therefore to cause maximum dehumidification. The leaving coolant from the outside air heat exchanger is the source of the coolant which then passes to the return air heat exchanger which cools and dehumidifies the return air. The leaving air streams from the return and outside air heat exchangers are mixed to become the supply air for a conditioned room which is economically dehumidified without need to overcool and reheat, nor to curtail the design flow rate of ventilation air and hence without contributing to conditions which are associated with the "sick building syndrome." As a consequence there results a design which performs to standards over its full range of operation with low noise and low operating costs.

19 Claims, 8 Drawing Sheets

AIR CONDITIONING FOR HUMID CLIMATES

Figure 1:
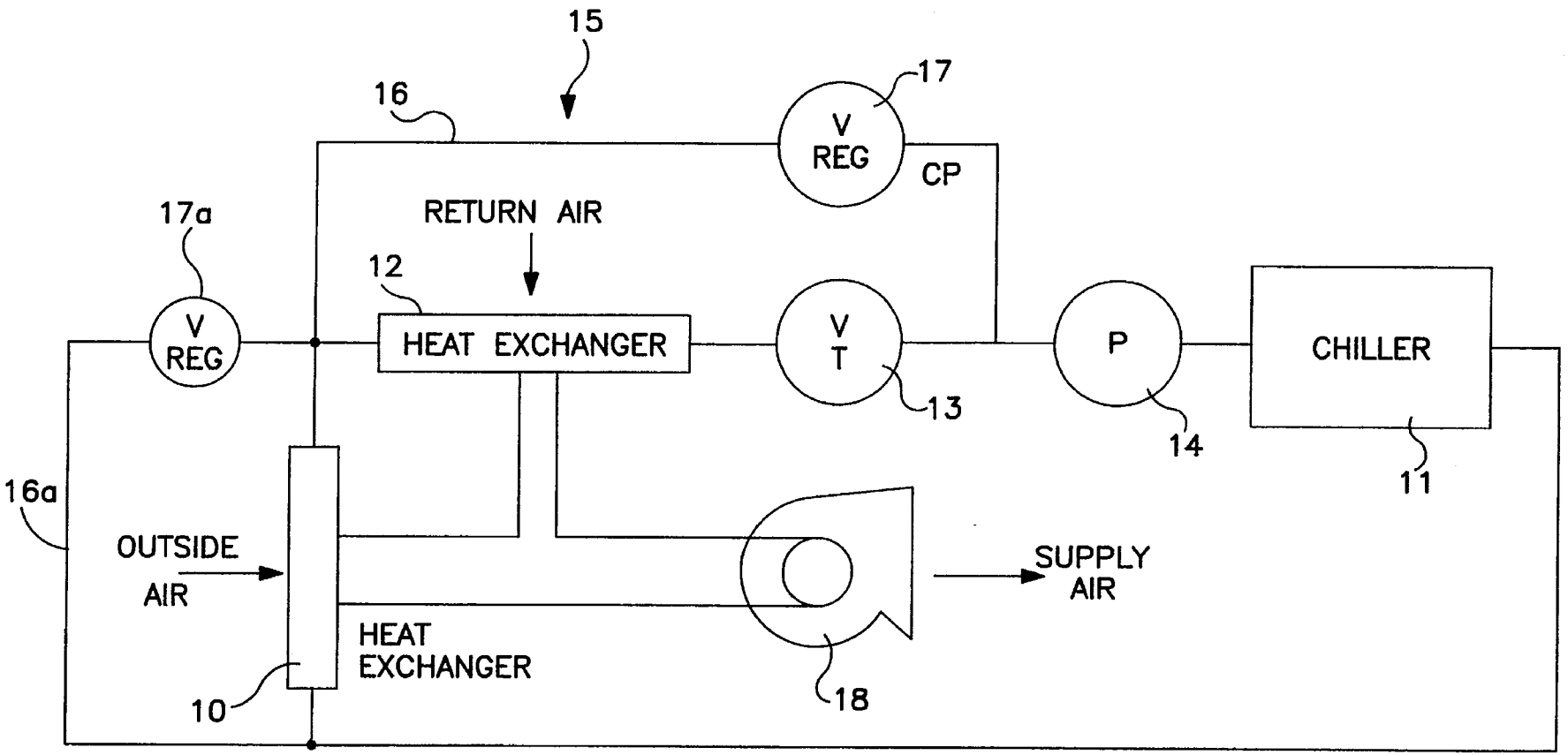

This invention relates to both a method and means for air conditioning, and although generally applicable, has special value when it is associated with air conditioning for humid and temperate climates.

BACKGROUND OF THE INVENTION

Tropical and humid climates present serious design problems at various combinations of climatic conditions with room sensible and latent heat load conditions. These problems also occur in temperate climates, often at non-peak humid weather conditions when room sensible heat load is low and the room latent heat load is high. The method of this invention, and the means necessary for that method to be performed, address the dynamics of the problem arising from changing climate, changing ventilation requirements and changing room sensible and latent heat loads. The objectives of the invention are to achieve low running costs, good performance within comfort standards, low first costs and low intrusion of the air conditioning equipment into rentable space. The main objective is to provide an improved system performance which can be achieved over a full operating range of the air conditioning system of the invention, and in particular, overcome the problems arising from humid air, inadequate ventilation and the associated health hazards (the "sick building syndrome").

The modern air conditioning system involves so many interacting variables that any attempt to make a scientifically valid assessment of performance over a complete operating range for each design, let alone to undertake a full optimisation, has always been regarded as impractical. Optimisation of one particular parameter, or of the range of one particular variable, at one particular operating condition affects other variables to an extent which can render the study valueless. These other variables are not necessarily affected at that particular operating condition. For example, in a system being selected in a temperate climate the peak refrigeration requirement usually occurs when high people loads, requiring high ventilation air supply, coincide with the afternoon peak of a hot day, during which transmission is at its maximum. A dehumidifier coil can be selected which, at this peak lead condition, satisfactorily meets that design requirement while making provision for future changes and allowing a safe margin for errors in the lead estimates. However the performance of this dehumidifier coil during certain critical part lead conditions depends on the way in which the designer has chosen to satisfy the peak lead condition. An excellent peak lead selection can, at part lead, result in a sick building with high humidity and outside air intake which is well below the minimum levels prescribed by the relevant Standard.

PRIOR ART

In tropical climates it is conventional practice to pro-cool the outside air, however the coolant leaving the outside air heat exchanger is not usually sent on to the return air heat exchanger since it is in no position to offset the room sensible and latent heat loads properly.

The chilled water serves only a small outside air flow rate based on ventilation specifications, and a very much larger return air flow rate determined by the room sensible heat difference between the design room dry bulb temperature and the supply air. In Singapore for the design of a multistorey office building this is usually in the ratio of outside air to return air flow rate of 1 to 10 or less.

In existing practice the chilled water flow rate would be selected to have a water temperature rise of about 8° C. for the outside air heat exchanger resulting in a reduced mass transfer of moisture from the air.

Figure 8:
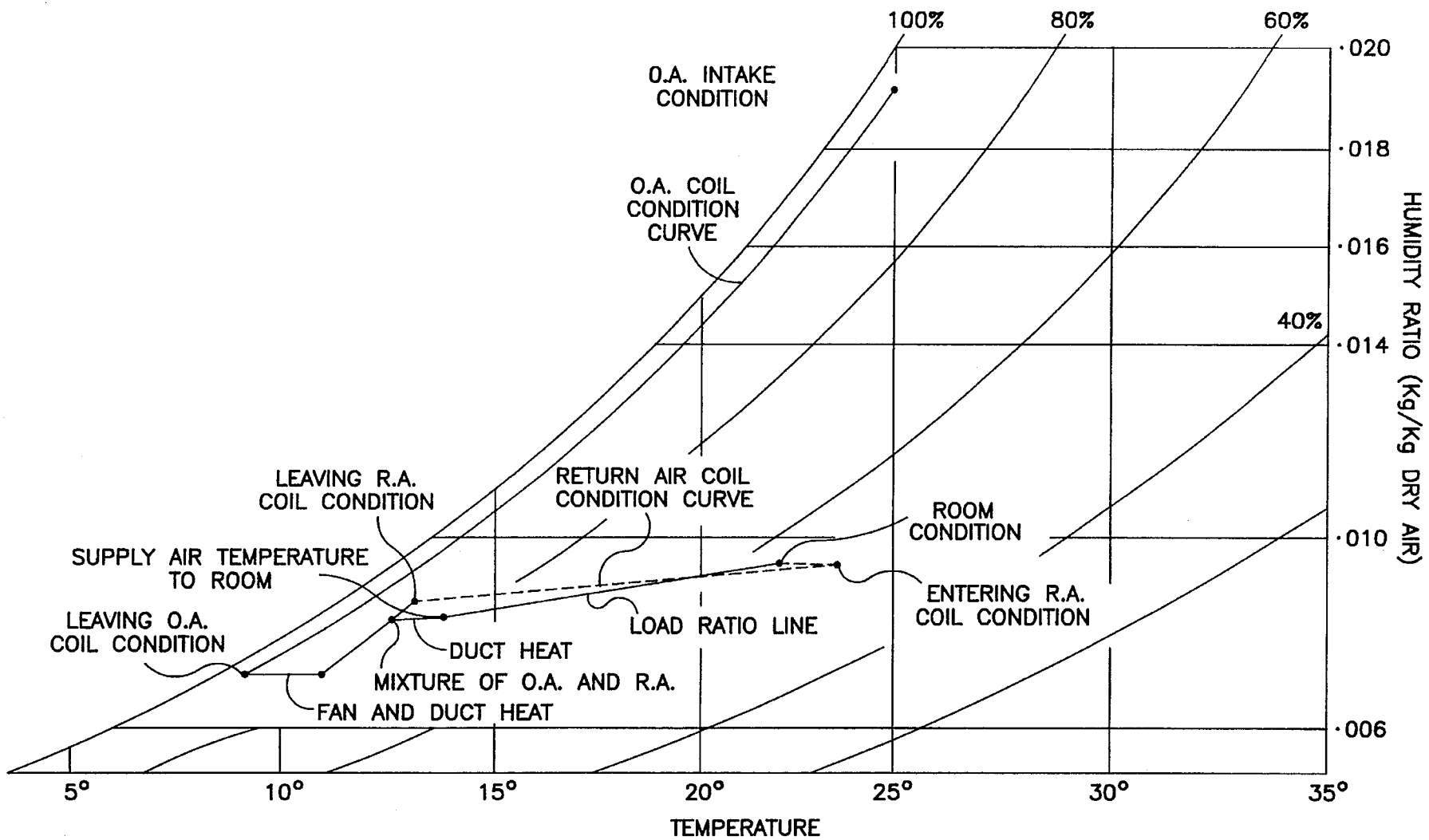

In this invention the outside air heat exchanger is served by a chilled led water flow rate which is inordinately large for the relatively small outside air flow rate passing through the exchanger. This is because it is based on the requirements of the peak simultaneous demand of the return air complex to which the outside air coolant then flows. Hence, in direct contrast to existing practice the water temperature rise across the outside air heat exchanger is very low, often under 1° C. The combination of a high chilled water flow rate, a low water temperature rise, a high water velocity through the outside air heat exchanger and an outside air heat exchanger design with many circuits with relatively short paths achieves the maximum dehumidification. The benefit of this is further enhanced by the outside air coil condition being close to the saturation curve during the critical humid part-load operation when the room sensible heat ratio is low and the outside air condition has a high humidity ratio. In this invention, the path of the coil condition curve through the outside air heat exchanger follows down adjacent to the saturation line of the psychrometric chart. The slope of the path of the outside air coil condition curve is therefore the steepest physically possible and very much steeper than the path of the return air coil condition curve. The return air may be treated separately through the return air heat exchanger before being mixed with the treated outside air, or the two may be mixed prior to passing together through the return air coil, whichever achieves the desired supply air conditions the more easily. On the mixing of the leaving outside air with the return air, the dew point of the supply air to the room is reduced. The deep dehumidification obtainable through the outside air heat exchanger serves as a replacement of methods where overcooling and reheating or equivalent is necessary to avoid excessive humidities in humid and tropical climates. FIG. 8 illustrates on a psychrometric chart the paths of the outside air and return air heat exchangers at part load conditions.

A serious problem is encountered in the otherwise excellent variable air volume system performance when for example at 50% room sensible heat load the outside air flow rate in a constant population density building doubles in percentage terms relative to the return air flow rate. During humid outside air conditions this often results in excessive relative humidity. In this invention quite the opposite occurs. The outside air is now shown to help the supply air to be at a lower dew point and to yield for the same load ratio line a lower room relative humidity.

The existing practice of pre-cooling of the outside air also differs from the invention in important aspects. Firstly the coolant flow paths are different because in existing practice the chilled water to the outside air heat exchanger does not usually flow onto the return air heat exchanger as in the case of this invention. Secondly, in the existing practice chilled water flow rate through the outside air heat exchanger is not based on the chilled water requirements of the return air heat exchanger complex during simultaneous building peak performance. Consequently the circuiting and coil design of the present invention is very different from the prior art, and the flow of fluids and heat and mass transfer strategy to offset the sensible and latent heat loads over a full climatic range (including its internal variations) is essentially very different.

Still further, in existing practice it is not known to include any bypassing arrangement around a throttled return air heat exchanger so as to ensure a maximum flow at all times through the outside air heat exchanger, including the critical condition when the room sensible heat ratio is low. This is a feature which is employed in this invention when return air heat exchanger design is compacted to fit into small spaces such as ceiling plenums.

Still further, the existing practice services the outside air heat exchanger with a separate source of chilled water from that required by the return air heat exchanger.

In this invention there is a reduced chilled water flow rate to the return air heat exchanger complex in that the outside air heat exchanger carries out part of the role of the return air heat exchanger complex.

As a consequence, in buildings where the outside air heat exchanger serves a large return air heat exchanger complex, the return air heat exchanger complex is reduced in size and requires smaller chilled water risers since it has been partially relieved of its function to offset some of the return air heat loads.

Though neglected in existing practice, in this invention the engineering design incorporates knowledge of the building heat loads over the climatic range and an understanding of the inter-relationships between peak heat load and part load performance. This data is revealed in detail in Tables 1 and 2 and in the performance map FIG. 3.

Existing practice for the peak return air condition would be to design for a water temperature rise of about 7° C. or 8° C. Excellent peak load performance may be obtained. However the chilled water temperature rise at a critical part load condition would have been well above the 7.6° C. shown below in Table 5 for the Standard part load condition because as the heat load decreases the water temperature rise increases when a fixed size heat exchanger is employed. At part load, the room condition would have been excessively humid. In this case, the water temperature rise at peak had to be 3.2° C. in order to prevent the water temperature rise exceeding 7.6° C. indicated in Table 5. Obviously, here the part load performance determined the peak load water flow rate. In the prior art, these fundamental relationships do not enter into the design considerations.

The failure of existing systems in humid and tropical climates to prevent high room humidities during critical conditions has often resulted in the supply air temperature to the rooms causing moisture to condense out within the room in the vicinity of the supply diffusers because of the room dew point being high enough above the supply air temperature to cause condensation. One solution conventionally used, raising the supply air temperature, may prevent this condensation from occurring. However it does not help to maintain the room humidity at a comfortable level. Instead it exacerbates the humidity problem since it causes the return air heat exchanger to dehumidify less. An object of this invention is therefore to provide a lower room humidity which does not exceed acceptable standards and which is both comfortable and allows lower supply air temperatures to be used without condensation forming on the supply air diffusers.

Other control means which are being used in prior art have included the throttling of coolant flow, but as indicated in our U.S. Pat. No. 4,876,858 and others, the conventional method of throttling the coolant flow in both constant air volume and variable air volume systems when room heat loads decrease has only a limited range when a single dehumidifying coil is employed. It can be shown that it is thermodynamically not possible to control, by throttling the coolant flow, both room dry bulb temperature and room humidity condition economically to be always within engineering comfort standards over a wide range of conditions. (See "conventional" curves in Stage 1 of FIGS. 3 and 5.) As the coolant flow rate decreases the dehumidification capacity of the coil also decreases. This is in sharp conflict with the fact that at low room sensible heat loads and constant or increasing room latent heat loads the dehumidification capacity of the coil is required to increase. The consequence is a high room humidity condition which may well be above engineering comfort standards, and can induce serious health hazards. This condition arises particularly at low room sensible heat ratios (which may be defined as the ratio of room sensible to room total heat, the total heat of course including both room sensible and latent heat.)

The present invention addresses the need to offset sensible and latent heat combinations over a range of climatic conditions. The dynamics of the numerous coil conditions imposed are subject to a large number of contending variables.

Conventional practice does not fully consider the effect of variations in room and outside air conditions, and the main object of this invention is to improve air conditioning methods and equipment and more effectively to meet demands for good performance, for human comfort and health and for low running costs.

BRIEF SUMMARY OF THE INVENTION

The following standard abbreviations are used in the specification, Tables and drawings:

OA: Outside air

RA: Return air

DBT: Dry bulb temperature

WBT: Wet bulb temperature

DPT: Dew point temperature

WTR: Water temperature rise

CHWS : Chilled water supply

WPD: Water pressure drop in kilo Pascals

Rm DT: Dry bulb temperature difference between leaving and supply air to treated space Rm SHR: Room sensible heat ratio C: Temperature °Celsius LPS : Liters/second RH: Relative humidity %

WV: Water vel. m/sec.

KW: Kilowatt energy

B1: Bottom of stage 1

T2: Top of stage 2

VAV: Variable air volume system

CAV: Constant air volume system

CCC: Coil condition curve LFV/HCV: Low face velocity (air)/High coolant velocity (water)

SA: Supply air temperature to the room

HE: Heat exchanger, air conditioning dehumidifier, cooling coil CA/RA/LFV/HCV: The system disclosed herein with a high driving potential for dehumidification In this invention, the dehumidifier of an air conditioning system is divided into two portions, one being an outside air heat exchanger and the other a return air heat exchanger. The configuration of the air conditioner is so arranged that coolant flows first through the heat exchange conduits of the outside air heat exchanger through which the outside air flows. The coolant, chilled water for example, has only a small water temperature rise across the outside air heat exchanger before it flows through the heat exchange conduits of the re=urn air heat exchanger, and the return air passes through the return air heat exchanger. With this arrangement the uncooled outside air is cooled by the coolant when the coolant is at its lowest mean temperature to achieve a maximum mean partial pressure difference of moisture and a maximum dew point temperature difference between the humid outside air and the wetted cooling surfaces of the heat exchanger. The effect is to increase dehumidification of the outside air at a high ratio of mass transfer to heat transfer because the coil condition curve is constrained to pass down along the curvature of the saturation line of the psychrometric chart. The outside air then mixes with the return air contributing to the dehumidification of the treated return air.

If the outside air heat exchanger is directly coupled to the return air heat exchanger the outside air heat exchanger, performance in dehumidifying is partially impaired when during part load the coolant flow rate through the outside air heat exchanger is reduced due to the throttling within the return air coil complex. This is no serious problem when the system employed uses the low face velocity/high coolant velocity technology, including the staging of the return air heat exchanger size as is the case in the example of the Singapore lecture theatre referred to herein. This design has three stages of return air heat exchanger size and consequently has sufficient assistance from the outside air flow treatment to meet the design specifications in spite of the direct coupled nature of the outside air heat exchanger to the return air heat exchanger. In fact it is not necessary in this case to require the leaving condition from the outside air heat exchanger to have a dew point below that of the supply air dew point. FIGS. 2, 3, 4, 5 and Tables 1 and 2 below describe this performance.

Figure 6:
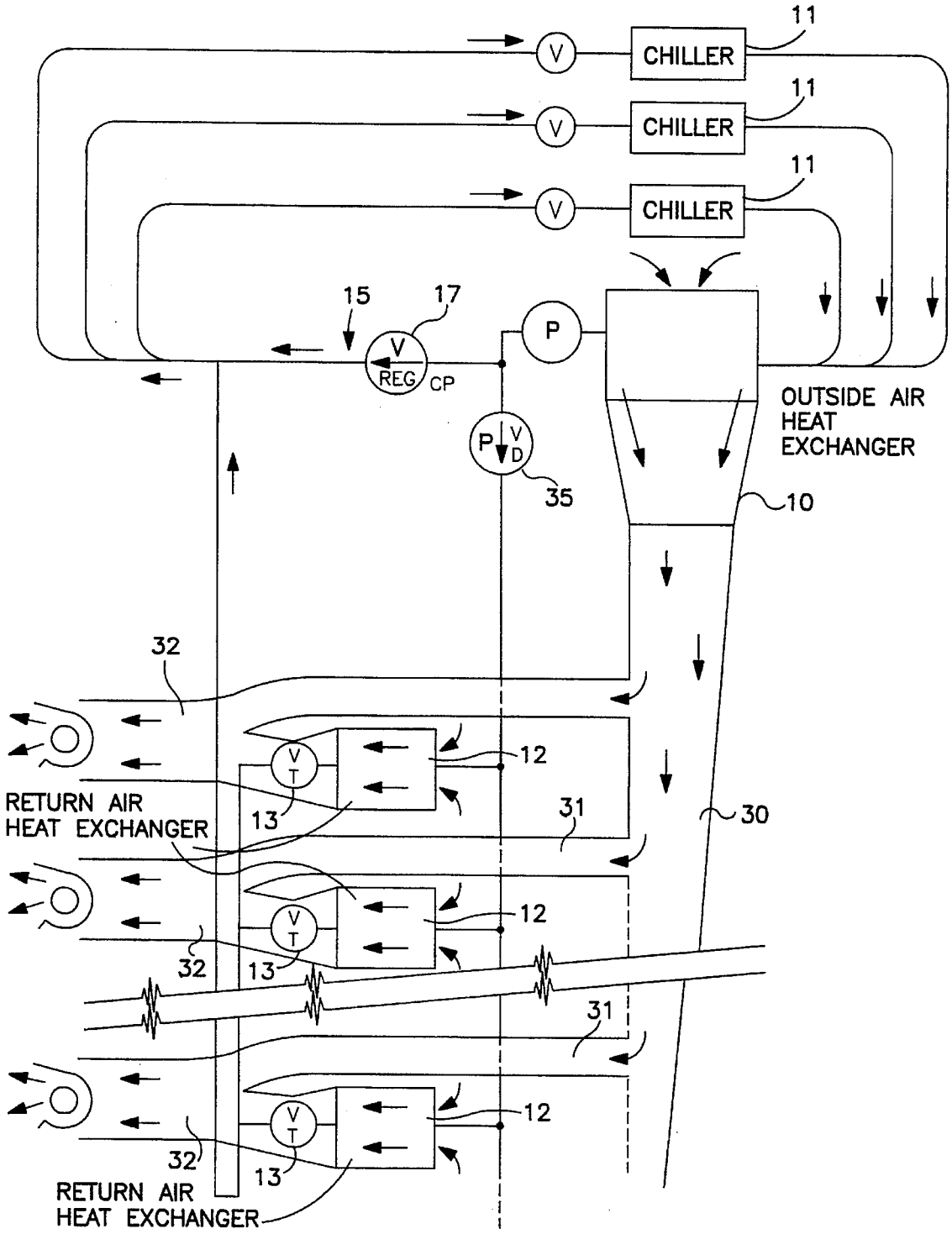

On the other hand much greater assistance is required when a Standard high face velocity, fixed size return air coil is employed. The coolant flow through the outside air heat exchanger in this case is designed not to be constrained by the throttling of coolant through the return air heat exchanger. This is accomplished by means of a bypass and a modulating valve designed to maintain the required coolant flow through the outside air heat exchanger. Table 4 below is an example of a design for a centrally located outside air heat exchanger which is serving an unconstrained coolant flow rate by means of a bypass and valve assembly. FIG. 6 is a schematic diagram which includes such a bypass where a single outside air heat exchanger serves a number of return air heat exchangers from a remote position close to the chillers. FIG. 1 is a similar bypass and valve arrangement where the outside air heat exchanger is adjacent to the return air heat exchanger it serves.

More specifically the invention is an air conditioning means for controlling the temperature and humidity of air in at least one space, with respect to air outside of that at least one space and heat and moisture sources within the at least one space, to a set temperature and humidity, comprising an outside air heat exchanger through which the outside air passes before passing into the at least one space, return air treatment means comprising at least one return air heat exchanger for each space through which air from the space passes before returning to the space, coolant flow conduits connecting the outside air and return air heat exchangers, the configuration of the conduits being arranged so that coolant is directed first through the outside air heat exchanger and subsequently through the at least one return air heat exchanger, pump means to circulate coolant through the outside and return air heat exchangers, control means for controlling the flow rate of coolant through the return air heat exchangers, air flow means to create both air flow of outside air through the outside air heat exchanger into the at least one space and to create air flow of air from within the at least one space through the return air heat exchanger connected to the space before returning back into the space, and air flow directing means which causes air from the outside and return air heat exchangers to mix before flowing into the at least one space, the outside air flow equalling at least the ventilation air requirements for the at least one space, the coolant flow through the outside air heat exchanger being such that the coolant entering the return air heat exchanger after exiting the outside air heat exchanger is at the temperature required to cool the incoming return air to a temperature and humidity such that when the air from the outside and return air heat exchangers are mixed and supplied to the at least one space, the air is at the set temperature and humidity in the at least one space.

This invention includes direct coupling of the coolant flows between the outside air and return air heat exchangers, but in one of its aspects also includes throttling means in said conduits of the return air heat exchanger arranged such that the coolant fed to the outside air coil section continues only in part to the return air heat exchanger, when a lower total coolant flow rate is required. By means of a bypass conduit across the return air heat exchanger, flow rate can be maintained at a high level through the outside air heat exchanger, and the outside air can be cooled to very low dew point temperatures in order to dehumidify sufficiently, with only a small increase in temperature of the cooling water flowing into the return air coil. This outside air, on mixing with the relatively larger portion of return air, is controlled so that the supply air temperature is at a condition to maintain the room target dry bulb temperature, and designed so that the room humidity is within comfort conditions. The invention may be interfaced with existing variable air volume and constant air volume installations, and may in many instances utilise standard temperature and throttling equipment otherwise employed, such as the balancing duct shown in FIG. 1.

This invention will be seen to be in contrast to conventional practice. In conventional practice minimum water temperature rise for the chilled water (if that is the coolant used) of say 5° C. to 9° C. in the outside air coil is normally chosen to minimise coolant pumping costs. In this invention the water temperature rise through the ventilation coil may be less than 3° C., and sometimes less than 1° C., as is the case in Table 4 where 0.80° C. is not exceeded at peak load. Furthermore, the operating cost of the conventional VAV system is 37.3% greater, and of the conventional CAV system is 102.0% greater than of this invention when satisfying human comfort standards, as disclosed here in Table 6.

The control of humidity within the air conditioned space can be readily effected in this invention by varying the flow of coolant through the return air heat exchanger, and the return air heat exchanger mainly serves to offset loads of sensible heat, and usually latent heat, which have been generated within that space. Separate humidity control means are not generally necessary, since free range of humidity is achieved through design to be contained within limits of comfort requirements.

The invention makes possible full ventilation requirements for part-load if used with the more common variable air volume systems. Although the invention can be used independently with great advantage, if combined with the high coolant velocity/low face velocity multi-stage systems of the aforesaid U.S. Pat. No. 4,876,858, very high energy savings can be achieved.

BRIEF SUMMARY OF THE DRAWINGS AND TABLES

Figure 2:
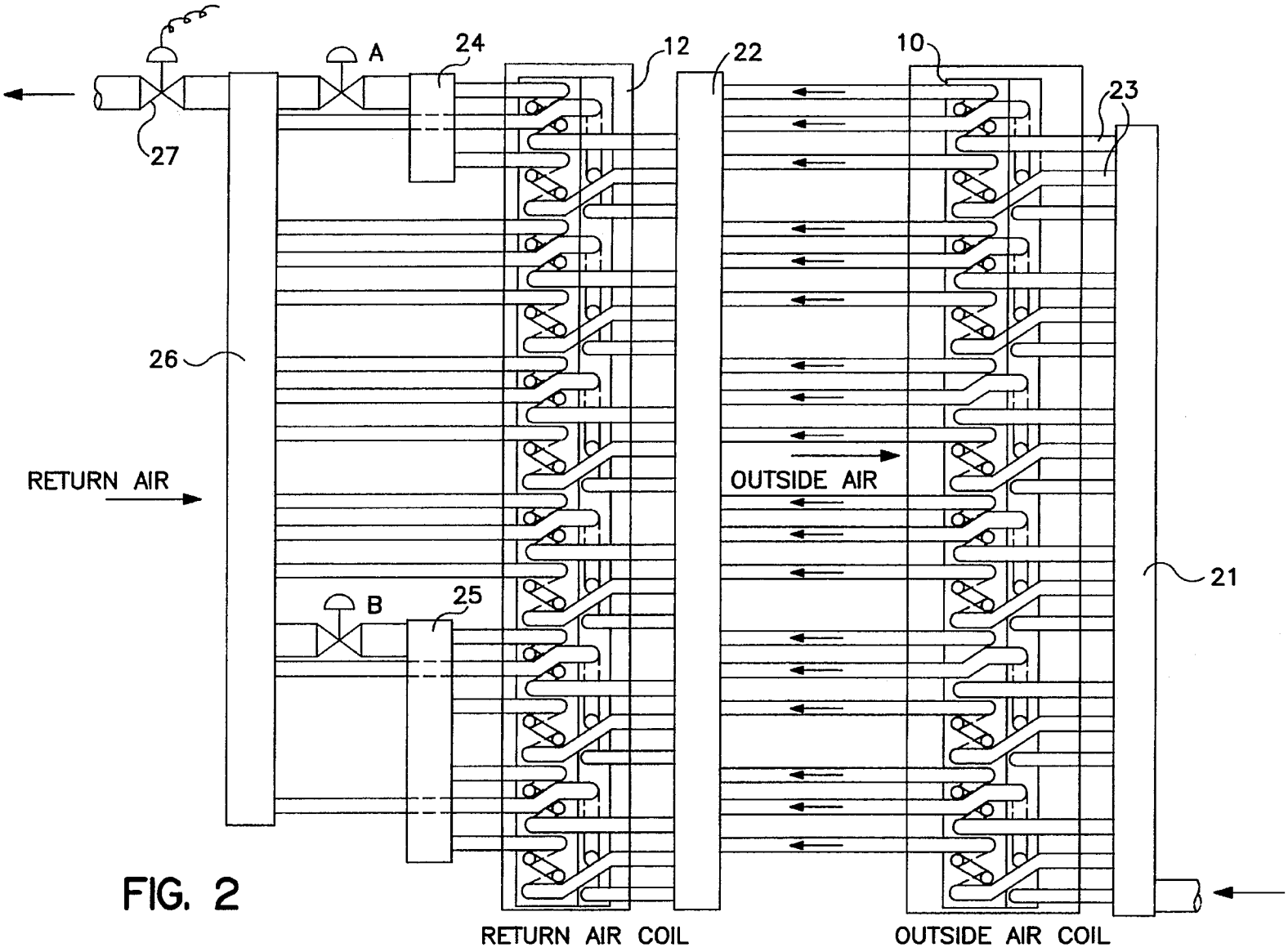
Figure 3:
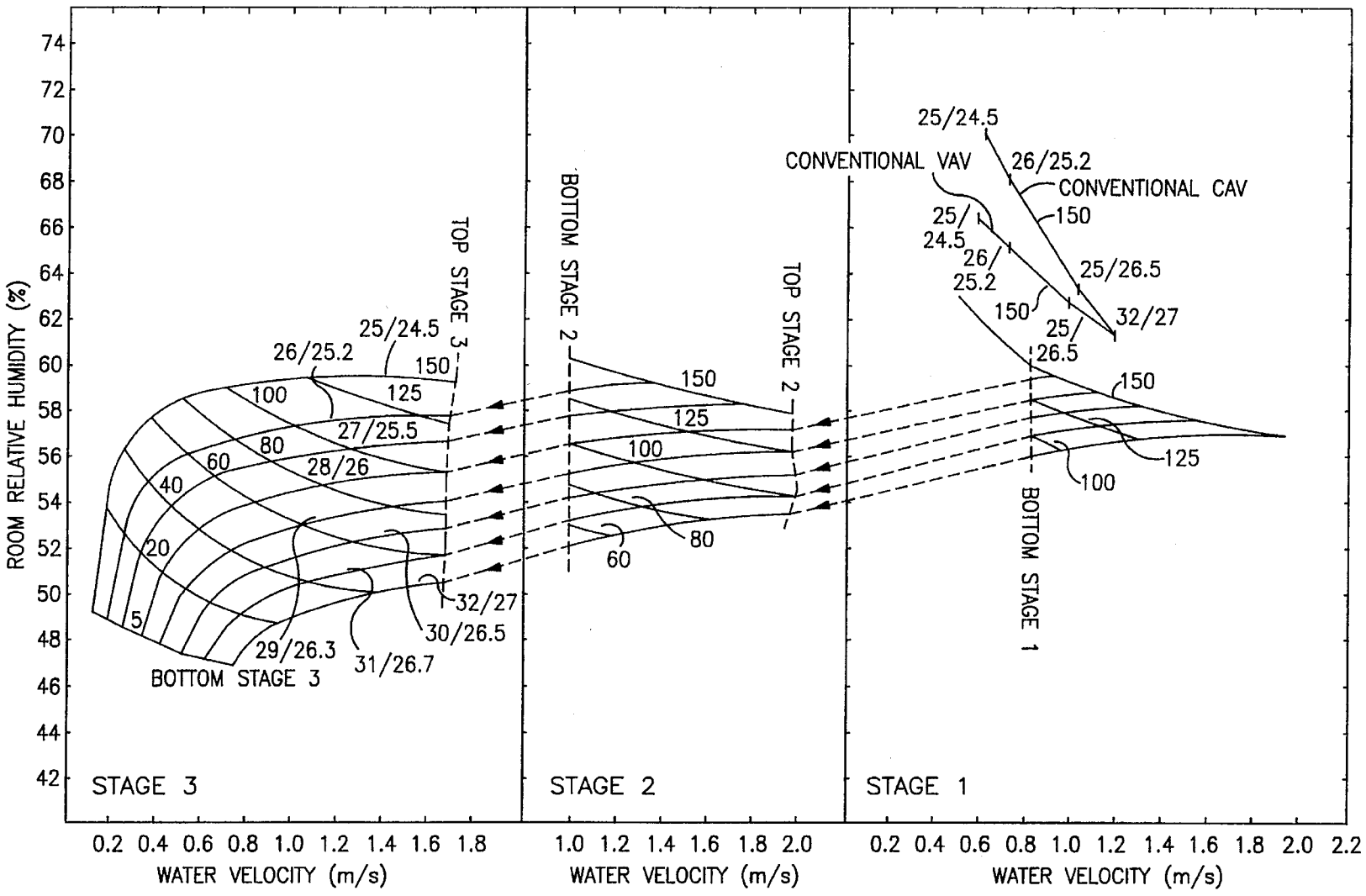
Figure 4:
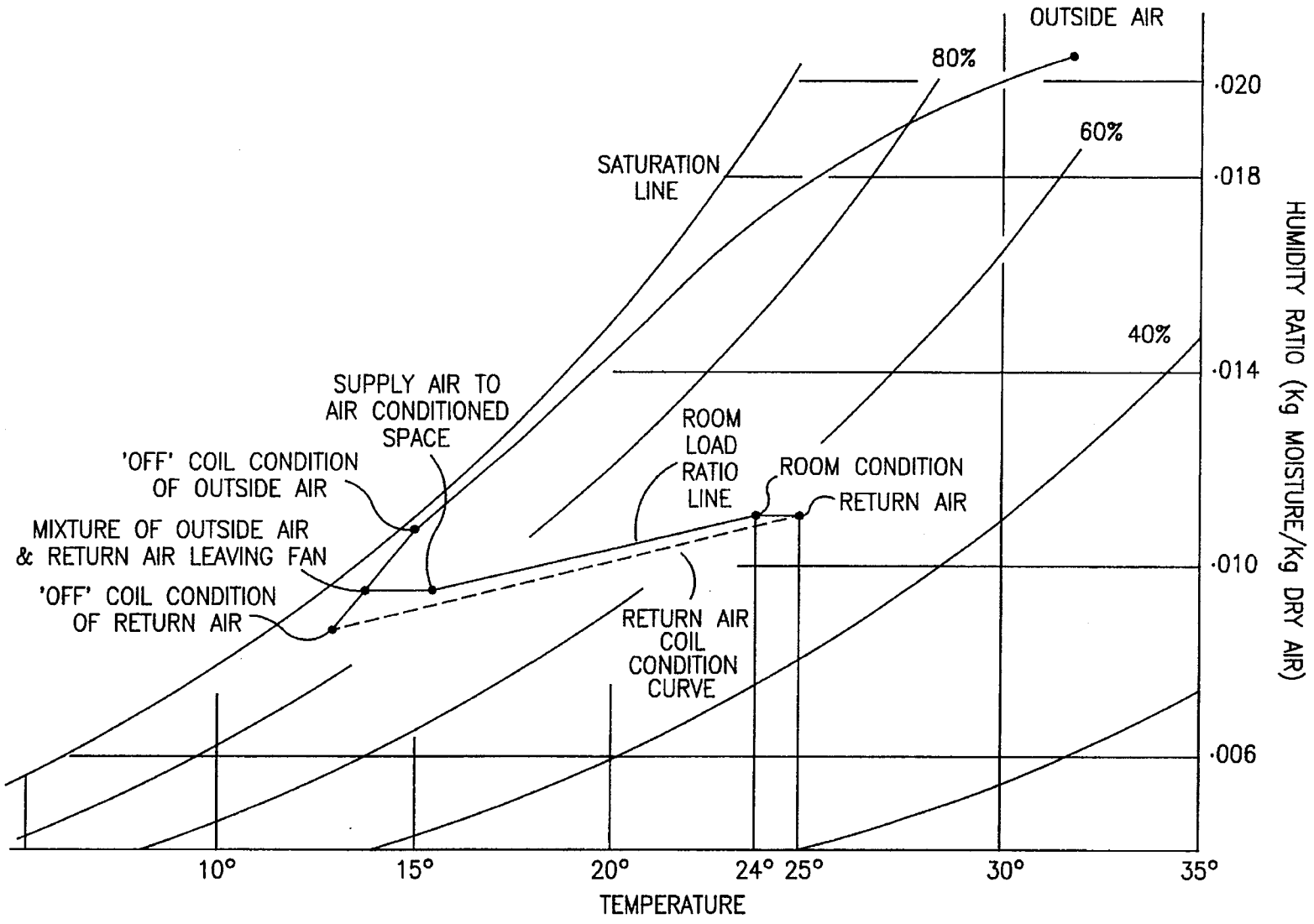
Figure 7:
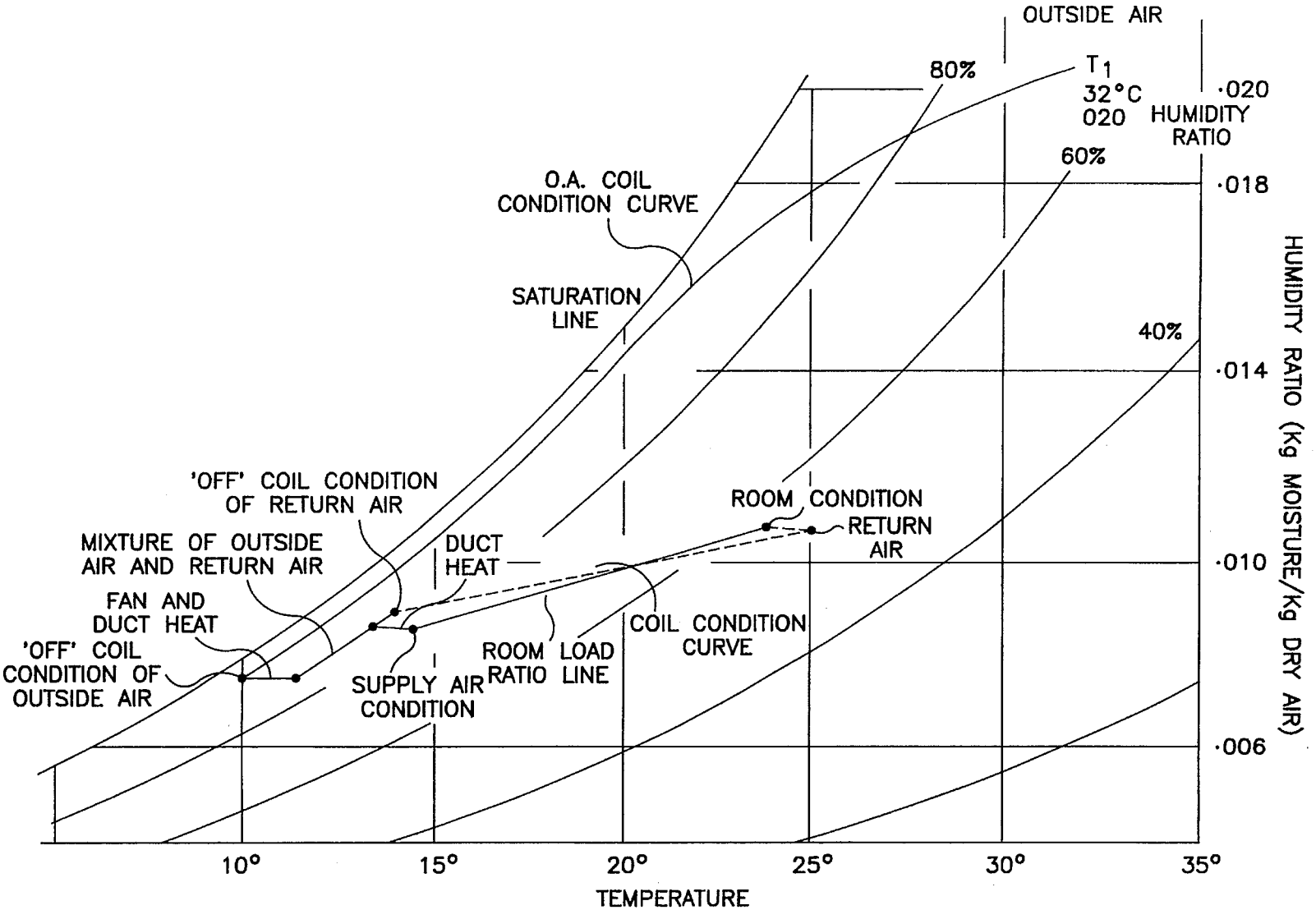

An embodiment of-the invention is described hereunder in some detail with reference to and as illustrated in the accompanying drawings in which:

FIG. 1 is a basic diagrammatic representation of an air conditioning system embodying treatment of outside air and return air in a single zone system where the outside air heat exchanger is adjacent to the return air heat exchanger. It includes an optional bypass with modulating pressure control to maintain full coolant flow rate through the outside air heat exchanger when return air heat exchanger flow is being throttled during part load conditions. In situations where the predominant latent load is that from within the building, a bypass may be placed around the outside air coil to transfer the major dehumidification load to the return air coil, FIG. 2 is a schematic view showing the detailed circuiting the coils of the system depicted in FIG. 1, without the optional bypasses, FIG. 3 shows a "map" illustrating the conditions between three. stages of air conditioning which are determined by load, and which utilise the valve arrangement of FIG. 2, FIG. 4 is a psychrometric chart which illustrates the embodiment described hereunder with respect to peak conditions when this invention is interfaced with a system which has a multi-stage return air heat exchanger. The outside air heat exchanger is not required to have a leaving off coil condition below the supply air DPT. The system has the OA coolant flow rate coupled directly to the Return Air coolant flow rate as indicated in FIG. 2. The performance specifications are fully satisfied, FIG. 5 indicates the performance of the three stage coil of FIG. 2 and compares it with conventional VAV and CAV performance with-respect to relative humidity over the full climatic range when the room shown in the Example of FIG. 3 has full occupancy, FIG. 6 diagrammatically illustrates multistorey installation illustrating the central outside air treatment system of this invention with a single outside air heat exchanger remotely located from separate Return Air heat exchangers and including a bypass with regulating valve and separate Return Air treatment means, FIG. 7 is a psychrometric chart which illustrates the embodiment described hereunder with respect to peak conditions, for the multistorey central outside air treatment system of this invention with a single outside air heat exchanger remotely located from a fixed size Return Air heat exchanger complex and including a bypass with regulating valve, such that the condition of said outside air leaving said outside air heat exchanger is such as to reduce further the dew point temperature of the return air leaving said Return Air Coil when the two are mixed, so allowing a smaller Return Air Coil to be used, FIG. 8 is a psychrometric chart which illustrates the embodiment described hereunder with respect to part load humid conditions for the same system of FIG. 7, wherein the Outside Air coil has a leaving condition which reduces the sensible cooling required from the Return Air Coil, Table 1 sets out change-over values in the three stage example in FIG. 3, for falling thermal loads, Table 2 sets out change-over values in three stage example of Table 1 for rising thermal loads, Table 3 shows some of the values for the arrangement of Tables 1 and 2, comparing however the performance when the system of the invention with the Return Air Coil incorporating the LFV/HCV disclosure in our aforesaid U.S. Pat. No. 4,876,858, a combination which we herein refer to as the Outside Air/Return Air/Low Face Velocity/High Coolant Velocity, or OA/RA/LFV/HCV system, is compared with corresponding conventional VAV and CAV systems, Table 4 indicates details of the outside air heat exchanger including performance at peak and part loads, and is relevant to FIGS. 7 and 8, Table 5 compares for an office building complex a "Prestige" system Return Air coil utilising two stages with a single stage "Standard" system which is of lower cost, and in the design of these systems, to permit a fair comparison, both the Prestige and Standard systems mix treated outside air with treated return air.

Table 6 indicates annual running costs of the invention compared with a conventional VAV installation and a conventional CAV installation for the lecture theatre example to which FIGS. 2, 3, 4 and 5 relate.

While, as said above, the invention can be utilised independently with some advantage, the invention can achieve the highest efficiency if it is used in conjunction with the low face velocity/high coolant velocity disclosure in our aforesaid U.S. Pat. No. 4,876,858. (Here the subject matter of that patent is abbreviated to "LFV/HCV".)

Referring to the drawings, FIG. 1 shows the principle of the invention in a very much simplified embodiment, wherein an outside air heat exchanger 10 is arranged to receive chilled water from a chiller 11, and chilled water flows through the outside air heat exchanger 10 rising in temperature only about 1° C. to 2° C., and then through a return air heat exchanger 12, the water passing through two lines, the lower line being illustrated to contain the regulating valve 13 which is a throttling valve for controlling the amount of water which flows through the heat exchanger 12, a pump 14 and back through the chiller to be recirculated.

A feature of this invention is that the coolant flow rate through the outside air heat exchanger is based on maximum simultaneous demand of the return air heat exchanger (which can be a bank of heat exchangers as indicated in FIG. 6) at peak load, but peak load seldom exists and when single fixed size RA heat exchangers are installed, they may fail to meet specifications during part load conditions. The problem is resolved by providing a bypass conduit valve assembly 15 which comprises a bypass conduit 16 and a regulating valve 17 which in effect bypasses a combination of heat exchanger 12 and regulating valve 13. As a result the outside air heat exchanger 10 receives a greater coolant flow and the return air coil complex deficiency is offset by improved performance of the outside air coil. A further bypass around the outside air heat exchanger is provided and comprises a balancing conduit **16*a* and valve 17*a*. The outside air gassing through heat exchanger 10 will mix with return air passing through heat exchanger 12 and is driven by a supply air blower or fan 18** to supply air to a space (room) which is to be air conditioned.

In FIG. 2, the outside air heat exchanger sits adjacent, and in the same cross-section as the return air heat exchanger perpendicular to the air flow. It illustrates a return air heat exchanger which permits three different stages representing three different active heat exchanger sizes. When Valve A and Valve B are open the total return air heat exchanger is active in Stage one. When Valve B is closed the heat exchanger has an intermediate size, when both Valves A and B are closed the heat exchanger is at its smallest active size. In addition the conventional modulating valve is indicated in the return chilled water conduit leaving the return manifold. The above staging is described in the aforesaid U.S. Pat. No. 4,876,858. The change-over points between staging are indicated on the Performance Tables 1 and 2 for both falling and rising room sensible heat loads.

FIG. 2 illustrates a system embodiment which is simpler than that shown in FIG. 1, in that by-pass assembly 15 and balancing conduit 16*a* are omitted and wherein chilled water supply goes into a manifold 21 and is directed through that manifold into the outside air heat exchanger 10 in a series of parallel circuits (with respect to coolant flow), there being illustrated 18 circuits each with four passes. The downstream manifold 26 receives the water from the return air heat exchanger 12, and redirects it to the chiller but through a modulating valve 27. It is evident that by introducing another manifold between the outside air section of the coil and manifold 22 and with a transfer pipe to manifold 22, the outside air coil section 10 can be mounted remotely from the return air coil section 12.

The physical arrangement which is in common use however is not limited to systems shown in FIG. 1 and FIG. 2, but normally utilises a single outside air heat exchanger 10 which is relatively large and which delivers air to a series of levels of a multistorey building through a duct 30 as shown in FIG. 6, from which the air is taken through side ducts 31 to be mixed in a mixing space 32 with air which has been passed from the air conditioned space through the return air heat exchangers 12 before being supplied to the conditioned space. Between 10% and 30% of return air is usually spilt or leaked from the air conditioned room and is replaced by outside air which comes through the outside air heat exchanger 10. There is thus a complex of return air heat exchangers, and the coolant flow rate from the chillers (three in number in FIG. 6) is necessarily based on the maximum simultaneous demands of all the air passing through the return air heat exchangers 12 at peak load, and should not be less than those demands but preferably a little more. This in turn is dependent on water temperature rise at peak load which must be compatible with the water temperature rise occurring at all load conditions within the range, and must be low enough to result in a room relative humidity which does not exceed the maximum permissible design limit. The range of the air conditioned space is usually between 22° C. and 27° C. temperature and between 30% and 60% relative humidity.

Our aforesaid U.S. Pat. No. 4,876,858 (or any one of its related family of patents) is included in this specification by way of reference, and the control means of the stages which are clearly set forth in that patent are utilised with only minor description herein.

FIGS. 3 and 4 illustrate the three stages of air conditioning in a lecture theatre in Singapore wherein difficulty is encountered in reducing humidity, and Table 1 (which comprises Tables 1A and 1B). Table 1 should be read in association with the falling loads of FIG. 3. FIG. 4 is also relevant to this description, FIG. 4 showing the peak condition of outside air having a temperature of 32° C. and outside air wet bulb temperature of 27° (corresponding approximately to a humidity ratio of 0.020). There is a much steeper slope of the outside air coil condition curve than the return air coil condition curve.

A feature of the LFV/HCV design methodology is that a range of design conditions, which is representative of the complete operating range envisaged for the plant, is considered during the selection of a dehumidifier coil. A global "Performance Map", covering the performance of the coil over the range of design conditions, is generated, and is illustrated in FIG. 3.

Showing the three stages of this embodiment, FIG. 3 has eight lines which slope upwardly to the left and which identify the number of occupants (the population) of the conditioned room, ranging from 150 maximum to five minimum. The change over control shown on the map of FIG. 3 is substantially the same as in our aforesaid U.S. Pat. No. 4,876,858, and is therefore not repeated herein. It will be noted however that the main control is coolant velocity regulated by throttle valves 13, or variable delivery pump 35, or both.

At the upper right hand side of FIG. 3, there is a comparison between the conventional constant air volume (CAV) system and the conventional variable air volume (VAV) system with the embodiment of the present system having adjacent outside air to return air heat exchangers coupled to each other and with three stages of return air coil size. No bypass is required to meet the specifications.

The data from which the performance map of FIG. 3 is generated are partially presented as Table 1. The map (FIG. 3) can include any or all of the variables and parameters listed in the tables. For clarity it is herein illustrated by the plots of room relative humidity, which is representative of the level of comfort achieved, versus the chilled water velocity in the active coil circuits, which is representative of the mechanical operation of the plant, for range of outside air conditions and occupancy numbers. In one example shown these latter parameters are representative respectively of the externally imposed and the internally generated loads. For another example the population of the room may not vary and thus the room latent load may be reasonably constant, but the room sensible load may vary through changes in the transmission load and the equipment being operated. As a general rule, the variables and parameters depicted visually on the map are chosen to be the most appropriate for conveying information about the plant and its operation in relation to the imposed loads.

The drawings and tables relate to conditions for falling loads, but are almost the same for rising loads, the latter being separately illustrated in Table 2.

The described embodiment relates to a system designed to service a lecture theatre in a tropical climate such as Singapore. The variation in the people loads and the accompanying ventilation loads are extreme in the example. The design challenge is to maintain both thermal comfort and the necessary ventilation air quantities for student numbers which range from the capacity searing of 150 down to tutorial groups of five to ten students.

The performance is achieved with FIG. 2 return air dehumidifier coils having 18 circuits. All 18 circuits of the ventilation air segment have 4 passes per circuit and are active at all times. All are active when in the high load range. In "Stage 1" (valves A and B open), only 14 circuits are active at intermediate loads with valve A open and B closed, ("Stage 2"), and the number of active circuits reduces to 12 at low loads with valves A and B closed, ("Stage 3"). The process of changing from one stage to another is referred to as "change over". There is only one chilled water feed. The water passes first through the outside air coil 10 and then through the return air coils 12 of the complex as shown in FIGS. 1 and 2. However, in this 3 stage coil design the bypasses shown in FIG. 1 are not necessary. The symbol T in the first column of Table 1 refers to the top of a Stage, that is, where the coolant velocity in the active circuits of that Stage is at its maximum. The symbol B refers to the bottom of a Stage where the coolant velocity is at its lowest value. For example, the symbol B2refers to the bottom of Stage 2. The total cooling requirements for-each of the design conditions defining the operating range are shown in the column headed Ref Cap.

The set points for change over from one stage to another are different for falling loads from those for rising loads to avoid hunting of the control system.

Figure 5:
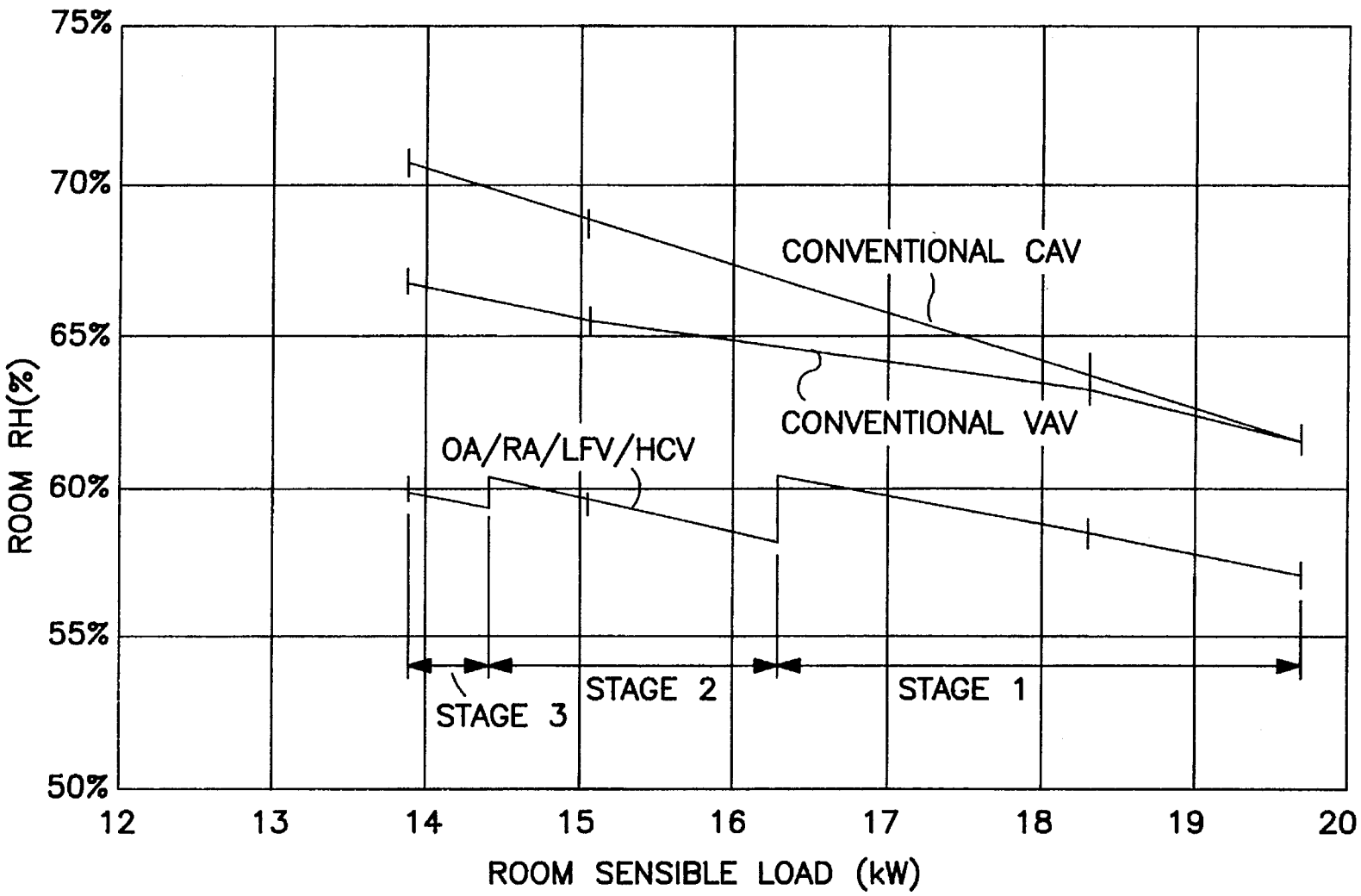

In FIG. 5 the effectiveness of the staging on room relative humidity with changes in room sensible heat load for the OA/RA/LFV/HCV system of Tables 1 and 2 is compared with a fixed stage CAV and VAV system under conditions of a full lecture theatre with 150 students.

The energy requirements to achieve the same performance for the conventional CAV and VAV systems as for the OA/RA/LFV/HCV are presented in Table 6, which also provides comparative annual running costs.

The supply air dry bulb temperature is chosen in each case to minimise the risk of condensate forming on the supply air diffusers. The lower supply air temperature possible with the LFV/HCV system results from the lower room dew point which can be achieved.

Difficulties are encountered however in circumstances of relatively low outside air temperature say 25° C. and relatively high outside air humidity say 95% for which it is required to meet standard comfort conditions in the room being air conditioned, and FIG. 8 illustrates how the FIGS. 7 and 8 graphically illustrate the advantage of the invention. The psychrometric charts show the large difference between the outside air dew point temperature of 25.3° C. and the almost constant chilled water temperature of about 7° C. which causes the outside air coil condition curve to follow a steep gradient downwardly to the left bringing it alongside the saturation line and reducing the humidity ratio in this instance from above 0.019 kg per kilogram of dry air down to below 0.007. The return air coil condition curve has a much flatter slope, and therefore the return air heat exchanger depends on the assisted dehumidification from the outside air heat exchanger. This method is particularly required where single fixed size return air heat exchangers with high face velocities are employed to fit into small spaces.

Table 4 indicates the performance at peak load and the critical part load outside air conditions for a 3,333 liters per second central OA handling unit serving ten storeys of an hypothetical office building located in Singapore. The quantity of air supplied to the occupied spaces totals 33,330 liters per second. The return air is treated by at least ten return air heat exchangers each handling 10% of the total supply air, that is 3,333 liters per second which is equal to the total of the outside air distributed throughout the whole building. The psychrometric charts of FIG. 7 and FIG. 8 indicate the coil condition curve path for peak and part load conditions respectively for the outside air heat exchanger and its associated return air heat exchangers.

The part load contribution of FIG. 8 relates to a system where there is an assembly having a bypass and risers with valves around the return air heat exchangers as illustrated in FIG. 6.

Table 5 identifies performance citing the most relevant values of air conditioning under the same peak and part loads, comparing on the one hand the invention applied to a two stage return air heat exchanger low face velocity VAV system with a standard high face velocity VAV system. Table 4 indicates the performance of the outside air heat exchanger associated with the return air heat exchanger in the configuration of FIG. 6.

It is a characteristic of the aforesaid LFV/HCV method that humidity does not need to be controlled, and with the combination of the present invention, there is still no need for separate control of humidity, that being inherent in the design of the air conditioning system. However with this invention, the humidity variation ranges within the conditioned space would be less when with the LFV/HCV systems and with multi-stages. In Table 5 such a configuration has been called "Prestige" design. In the Prestige design the chilled water flow rate is considerably reduced. It required 4.6 liters per second at peak whereas the Standard design requires for a 77.4 kW application a higher but still a reasonably low chilled water flow rate of 6.5 liters per second. For comparison, this 77.4 kW application would require 13.1 liters per second of chilled water at peak load conditions, when the outside air is premixed prior to entering its heat exchanger.

TABLE 1A

CHANGEOVER ON FALLING THERMAL LOADS
Changeover from Stage 1 to Stage 2 - Water Velocity Reducing to 0.8 m/s

| Stage | | O/A dbt | O/A wbt | Pop'n | Rm Sens Kw | Rm SHR | WV m/s | WPD kPa | Ch W lps | O/A lps | R/A lps | SA dpl | Rm W g/kg | Rm RH | Ref Cap kW | WTA C | Lps/ person |
|---|---|---|---|---|---|---|---|---|---|---|---|---|---|---|---|---|---|
| B1 | | | | | | | 0.08 | 7.34 | 2.518 | 472.8 | 881.1 | 12.93 | 10.49 | 56.31% | 42.41 | 4.03 | 5.4 |
| | > | 32.0 | 27.0 | 88.1 | 15.52 | 0.759 | | | | | | | | | | | |
| T2 | | | | | | | 1.05 | 30.09 | 4.769 | 472.8 | 862.5 | 12.10 | 0.09 | 63.66% | 43.14 | 2.16 | 5.4 |
| B1 | | | | | | | 0.80 | 7.34 | 2.516 | 477.9 | 869.7 | 12.05 | 10.67 | 57.23% | 42.62 | 4.04 | 4.7 |
| | > | 31.0 | 26.7 | 101.2 | 15.68 | 0.736 | | | | | | | | | | | |
| T2 | | | | | | | 1.08 | 30.06 | 4.846 | 477.9 | 871.1 | 12.12 | 10.16 | 64.67% | 43.26 | 2.13 | 4.7 |
| B1 | | | | | | | 0.80 | 7.34 | 2.516 | 480.7 | 874.9 | 12.96 | 10.82 | 68.03% | 42.58 | 4.04 | 4.3 |
| | > | 30.0 | 26.5 | 112.8 | 15.77 | 0.715 | | | | | | | | | | | |
| T2 | | | | | | | 1.08 | 30.90 | 4.841 | 480.7 | 876.4 | 12.16 | 10.33 | 65.47% | 43.30 | 2.14 | 4.3 |
| B1 | | | | | | | 0.80 | 7.34 | 2.616 | 484.6 | 882.0 | 12.97 | 10.97 | 68.83% | 42.61 | 4.04 | 3.9 |
| | > | 20.0 | 26.3 | 124.9 | 15.00 | 0.698 | | | | | | | | | | | |
| T2 | | | | | | | 1.07 | 30.55 | 4.810 | 484.6 | 883.4 | 12.21 | 10.61 | 66.39% | 43.30 | 2.15 | 3.9 |
| B1 | | | | | | | 0.80 | 7.34 | 2.516 | 489.1 | 890.3 | 12.97 | 11.15 | 69.70% | 42.65 | 4.01 | 3.5 |

TABLE 1A-continued

CHANGEOVER ON FALLING THERMAL LOADS
Changeover from Stage 1 to Stage 2 - Water Velocity Reducing to 0.8 m/s

| Stage | O/A dbt | O/A wbt | Pop'n | Rm Sens Kw | Rm SHR | WV m/s | WPD kPa | Ch W lps | O/A lps | R/A lps | SA dpl | Rm W g/kg | Rm RH | Ref Cap kW | WTA C | Lps/ person |
|---|---|---|---|---|---|---|---|---|---|---|---|---|---|---|---|---|
| > | 28.0 | 26.0 | 139.4 | 16.05 | 0.674 | | | | | | | | | | | |
| T2 | | | | | | 1.97 | 30.61 | 4.815 | 481.7 | 891.7 | 12.24 | 10.71 | 67.48% | 43.31 | 2.15 | 3.5 |
| 2 | 27.0 | 25.5 | 150.0 | 15.06 | 0.655 | 1.74 | 24.61 | 4.252 | 483.4 | 880.9 | 12.32 | 10.02 | 60.64% | 41.80 | 2.35 | 3.2 |
| 2 | 26.0 | 25.2 | 150.0 | 15.03 | 0.643 | 1.36 | 16.05 | 3.332 | 453.9 | 838.8 | 12.42 | 11.09 | 69.44% | 38.90 | 2.79 | 3.0 |

TABLE 1B

CHANGEOVER ON FALLING THERMAL LOADS
Changeover from Stage 2 to Stage 3 - Water Velocity reducing to 1.0 m/s

| Stage | O/A dbt | O/A wbt | Pop'n | Rm Sens kW | Rm SHR | WV m/s | WPD kPa | Ch W Lps | O/A lps | R/A lps | SA dpl | Rm W g/kg | Rm RH | Ref Cap kW | WTR C | Lps/ person |
|---|---|---|---|---|---|---|---|---|---|---|---|---|---|---|---|---|
| B2 | | | | | | 1.00 | 9.35 | 2.446 | 393.7 | 717.6 | 12.31 | 9.72 | 52.24% | 34.66 | 3.38 | 8.0 |
| > | 32.0 | 27.0 | 49.5 | 12.92 | 0.824 | | | | | | | | | | | |
| T3 | | | | | | 1.65 | 20.89 | 3.456 | 393.7 | 718.2 | 11.82 | 9.44 | 50.73% | 35.00 | 2.42 | 8.0 |
| B2 | | | | | | 1.00 | 9.35 | 2.446 | 396.5 | 723.0 | 12.34 | 9.93 | 53.35% | 34.69 | 3.39 | 6.4 |
| > | 31.0 | 26.7 | 61.6 | 13.02 | 0.791 | | | | | | | | | | | |
| T3 | | | | | | 1.66 | 21.15 | 3.480 | 399.2 | 728.1 | 11.93 | 9.87 | 53.01% | 35.11 | 2.41 | 5.5 |
| B2 | | | | | | 1.00 | 9.35 | 2.446 | 399.2 | 727.4 | 12.38 | 10.13 | 54.41% | 34.79 | 3.40 | 5.5 |
| > | 30.0 | 26.5 | 73.1 | 13.10 | 0.763 | | | | | | | | | | | |
| T3 | | | | | | 1.66 | 21.15 | 3.480 | 399.2 | 728.1 | 11.93 | 9.87 | 53.01% | 35.11 | 2.41 | 5.5 |
| B2 | | | | | | 1.00 | 9.35 | 2.446 | 402.8 | 734.0 | 12.43 | 10.35 | 55.55% | 34.89 | 3.41 | 4.7 |
| > | 29.0 | 26.3 | 85.1 | 13.22 | 0.736 | | | | | | | | | | | |
| T3 | | | | | | 1.66 | 21.05 | 3.471 | 402.8 | 734.7 | 12.01 | 10.10 | 54.22% | 35.20 | 2.42 | 4.7 |
| B2 | | | | | | 1.00 | 9.35 | 2.446 | 406.5 | 741.0 | 12.48 | 10.59 | 56.62% | 34.95 | 3.41 | 4.1 |
| > | 28.0 | 26.0 | 99.2 | 13.34 | 0.707 | | | | | | | | | | | |
| T3 | | | | | | 1.66 | 21.11 | 3.476 | 406.5 | 741.8 | 12.08 | 10.35 | 55.56% | 35.25 | 2.42 | 41 |
| B2 | | | | | | 1.00 | 9.35 | 2.446 | 413.6 | 753.6 | 12.52 | 10.84 | 58.16% | 34.93 | 3.41 | 3.6 |
| > | 27.0 | 25.5 | 116.0 | 13.57 | 0.678 | | | | | | | | | | | |
| T3 | | | | | | 1.67 | 21.27 | 3.491 | 413.6 | 754.2 | 12.14 | 10.62 | 56.97% | 35.22 | 2.41 | 3.6 |
| B2 | | | | | | 1.00 | 9.36 | 2.446 | 413.1 | 763.7 | 12.54 | 11.08 | 59.32% | 34.85 | 3.41 | 3.2 |
| > | 26.0 | 25.2 | 130.1 | 13.69 | 0.654 | | | | | | | | | | | |
| T3 | | | | | | 1.68 | 21.55 | 3.517 | 413.1 | 764.3 | 12.18 | 10.85 | 58.18% | 35.23 | 2.39 | 3.2 |
| 3 | 25.0 | 24.5 | 150.0 | 13.85 | 0.624 | 1.61 | 20.09 | 3.378 | 414.2 | 777.3 | 12.26 | 11.17 | 59.87% | 34.61 | 2.45 | 2.8 |
| 3 | 32.0 | 27.0 | 5.0 | 9.92 | 0.973 | 0.75 | 5.23 | 1.563 | 302.2 | 551.4 | 11.85 | 8.75 | 47.07% | 25.49 | 3.90 | 60.4 |
| 3 | 31.0 | 26.7 | 5.0 | 9.20 | 0.971 | 0.62 | 3.75 | 1.290 | 280.3 | 511.3 | 11.88 | 8.77 | 47.21% | 23.16 | 4.29 | 56.1 |
| 3 | 30.0 | 26.5 | 5.0 | 8.51 | 0.988 | 0.51 | 2.73 | 1.073 | 259.4 | 472.8 | 11.95 | 8.83 | 47.49% | 21.06 | 4.69 | 51.9 |
| 3 | 29.0 | 28.3 | 5.0 | 7.82 | 0.966 | 0.42 | 1.96 | 0.885 | 238.4 | 434.3 | 12.04 | 8.89 | 47.80% | 18.95 | 5.11 | 47.7 |
| 3 | 28.0 | 26.0 | 5.0 | 6.99 | 0.962 | 0.34 | 1.32 | 0.702 | 213.1 | 388.2 | 12.12 | 8.95 | 48.15% | 16.53 | 5.62 | 42.6 |
| 3 | 27.0 | 25.5 | 5.0 | 6.09 | 0.956 | 0.25 | 0.82 | 0.531 | 185.6 | 338.2 | 12.22 | 9.04 | 48.61% | 13.85 | 6.23 | 37.1 |
| 3 | 26.0 | 25.2 | 5.0 | 5.25 | 0.950 | 0.19 | 0.52 | 0.405 | 156.1 | 295.4 | 12.27 | 9.09 | 48.87% | 11.56 | 6.82 | 31.2 |
| 3 | 25.0 | 24.5 | 5.0 | 4.08 | 0.936 | 0.12 | 0.24 | 0.260 | 116.4 | 235.1 | 12.32 | 9.18 | 49.35% | 8.40 | 7.72 | 23.3 |

TABLE 2A

| Stage | O/A dbt | O/A wbt | Pop'n | Rm Sens kW | Rm SHR | WV m/s | Ch W Lps | O/A lps | R/A lps | SA dpl | Rm W g/kg | Rm RH | Ref Cap kW | WTR C | Lps/ person |
|---|---|---|---|---|---|---|---|---|---|---|---|---|---|---|---|
| CHANGEOVER ON RISING THERMAL LOADS | | | | | | | | | | | | | | | |
| over-capacity | 32.0 | 27.0 | 150.0 | 20.70 | 0.722 | 2.11 | 6.643 | 600.0 | 1207.1 | 12.32 | 10.43 | 56.00% | 58.73 | 2.11 | 4.0 |
| T1 (Peak) | 32.0 | 27.0 | 150.0 | 19.69 | 0.702 | 1.92 | 6.041 | 600.0 | 1093.3 | 12.53 | 10.66 | 57.19% | 56.38 | 2.23 | 4.0 |
| T1 | 31.0 | 26.7 | 150.0 | 18.97 | 0.694 | 1.54 | 4.852 | 578.1 | 1053.0 | 12.65 | 10.79 | 57.87% | 53.35 | 2.63 | 3.9 |
| T1 | 30.0 | 26.5 | 150.0 | 18.28 | 0.686 | 1.30 | 4.074 | 557.2 | 1014.4 | 12.73 | 10.90 | 58.48% | 50.70 | 2.97 | 3.7 |
| T1 | 29.0 | 26.3 | 150.0 | 17.60 | 0.678 | 1.10 | 3.449 | 536.2 | 976.8 | 12.81 | 11.02 | 59.10% | 48.01 | 3.32 | 3.6 |
| T1 | 28.0 | 26.0 | 150.0 | 16.77 | 0.667 | 0.91 | 2.862 | 510.9 | 930.5 | 12.91 | 11.17 | 59.89% | 44.89 | 3.75 | 3.4 |
| CHANGEOVER FROM STAGE 2 TO STAGE 1 - WATER VELOCITY INCREASING TO 2.1 m/s | | | | | | | | | | | | | | | |

TABLE 2A-continued

| Stage | O/A dbt | O/A wbt | Pop'n | Rm Sens kW | Rm SHR | WV m/s | Ch W Lps | O/A lps | R/A lps | SA dpl | Rm W g/kg | Rm RH | Ref Cap kW | WTR C | Lps/ person |
|---|---|---|---|---|---|---|---|---|---|---|---|---|---|---|---|
| B1 | | | | | | 0.84 | 2.633 | 480.4 | 874.9 | 12.91 | 10.51 | 56.40% | 43.22 | 3.92 | 5.2 |
| > | 32.0 | 27.0 | 91.8 | 15.77 | 0.755 | | | | | | | | | | |
| T2 | | | | | | 2.10 | 5.137 | 480.4 | 876.4 | 12.08 | 10.01 | 53.75% | 43.96 | 2.04 | 5.2 |
| B1 | | | | | | 0.83 | 2.606 | 483.8 | 880.4 | 12.94 | 10.68 | 57.30% | 43.15 | 3.95 | 4.6 |
| > | 31.0 | 26.7 | 104.1 | 15.87 | 0.733 | | | | | | | | | | |
| T2 | | | | | | 2.10 | 5.137 | 483.8 | 881.9 | 12.10 | 10.18 | 54.63% | 43.90 | 2.04 | 4.6 |
| B1 | | | | | | 0.83 | 2.608 | 486.8 | 886.0 | 12.94 | 10.83 | 58.08% | 43.21 | 3.96 | 4.2 |
| > | 30.0 | 26.5 | 115.7 | 15.97 | 0.713 | | | | | | | | | | |
| T2 | | | | | | 2.10 | 5.137 | 486.8 | 887.5 | 12.14 | 10.34 | 55.51% | 43.94 | 2.04 | 4.2 |
| B1 | | | | | | 0.83 | 2.618 | 491.3 | 894.4 | 12.95 | 10.98 | 58.88% | 43.31 | 3.95 | 3.8 |
| > | 29.0 | 26.3 | 128.2 | 18.12 | 0.693 | | | | | | | | | | |
| T2 | | | | | | 2.10 | 5.137 | 491.3 | 895.8 | 12.18 | 10.52 | 58.44% | 44.01 | 2.05 | 3.8 |
| B1 | | | | | | 0.83 | 2.616 | 495.7 | 902.6 | 12.95 | 11.16 | 59.82% | 43.33 | 3.96 | 3.5 |
| > | 28.0 | 26.0 | 142.6 | 16.27 | 0.672 | | | | | | | | | | |
| T2 | | | | | | 2.10 | 5.137 | 495.7 | 904.0 | 12.22 | 10.72 | 57.49% | 44.01 | 2.05 | 3.5 |
| 2 | 27.0 | 25.5 | 150.0 | 15.87 | 0.655 | 1.74 | 4.252 | 483.4 | 880.9 | 12.32 | 10.92 | 58.54% | 41.80 | 2.35 | 3.2 |
| 2 | 26.0 | 25.2 | 150.0 | 15.03 | 0.643 | 1.36 | 3.332 | 453.9 | 838.8 | 12.42 | 11.09 | 59.44% | 38.90 | 2.79 | 3.0 |

TABLE 2B

CHANGEOVER ON RISING THERMAL LOADS
CHANGEOVER FROM STAGE 3 TO STAGE 2 - WATER VELOCITY INCREASING TO 2.1 m/s

| Stage | O/A dbt | O/A wbt | Pop'n | Rm Sens kW | Rm SHR | WV m/s | Ch W Lps | O/A lps | R/A lps | SA dpl | Rm W g/kg | Rm RH | Ref Cap kW | WTR C | Lps/ person |
|---|---|---|---|---|---|---|---|---|---|---|---|---|---|---|---|
| B2 | | | | | | 1.20 | 2.928 | 417.0 | 759.9 | 12.25 | 9.82 | 53.75% | 37.13 | 3.03 | 6.8 |
| > | 32.0 | 27.0 | 60.9 | 13.68 | 0.801 | | | | | | | | | | |
| T3 | | | | | | 2.10 | 4.403 | 417.0 | 760.6 | 11.76 | 9.54 | 51.25% | 37.49 | 2.03 | 6.8 |
| B2 | | | | | | 1.19 | 2.916 | 419.5 | 764.4 | 12.28 | 10.01 | 53.77% | 37.07 | 3.04 | 5.8 |
| > | 31.0 | 26.7 | 72.7 | 13.76 | 0.773 | | | | | | | | | | |
| T3 | | | | | | 2.10 | 4.403 | 419.5 | 765.1 | 11.81 | 9.74 | 52.31% | 37.43 | 2.03 | 5.8 |
| B2 | | | | | | 1.19 | 2.916 | 422.0 | 769.4 | 12.32 | 10.20 | 54.77% | 37.14 | 3.04 | 5.0 |
| > | 30.0 | 26.5 | 84.2 | 13.85 | 0.747 | | | | | | | | | | |
| T3 | | | | | | 2.10 | 4.403 | 422.0 | 770.1 | 11.87 | 9.94 | 53.37% | 37.49 | 2.03 | 5.0 |
| B2 | | | | | | 1.20 | 2.023 | 426.2 | 776.9 | 12.37 | 10.41 | 55.85% | 37.27 | 3.05 | 4.4 |
| > | 29.0 | 26.3 | 96.4 | 13.99 | 0.723 | | | | | | | | | | |
| T3 | | | | | | 2.10 | 4.403 | 426.2 | 777.6 | 11.95 | 10.16 | 54.53% | 37.60 | 2.04 | 4.4 |
| B2 | | | | | | 1.19 | 2.919 | 429.9 | 783.9 | 12.42 | 10.64 | 57.07% | 37.30 | 3.05 | 3.9 |
| > | 28.0 | 26.0 | 110.6 | 14.11 | 0.696 | | | | | | | | | | |
| T3 | | | | | | 2.10 | 4.403 | 429.9 | 784.6 | 12.01 | 10.40 | 55.80% | 37.62 | 2.04 | 3.9 |
| B2 | | | | | | 1.19 | 2.908 | 436.8 | 796.2 | 12.45 | 10.87 | 58.32% | 37.20 | 3.06 | 3.4 |
| > | 27.0 | 25.5 | 127.3 | 14.34 | 0.669 | | | | | | | | | | |
| T3 | | | | | | 2.10 | 4.403 | 436.8 | 796.8 | 12.07 | 10.65 | 57.13% | 37.50 | 2.03 | 3.4 |
| B2 | | | | | | 1.18 | 2.890 | 435.6 | 805.1 | 12.48 | 11.08 | 59.40% | 37.12 | 3.07 | 3.1 |
| > | 26.0 | 25.2 | 141.1 | 14.43 | 0.648 | | | | | | | | | | |
| T3 | | | | | | 2.10 | 4.403 | 435.6 | 805.7 | 12.11 | 10.86 | 59.25% | 37.41 | 2.03 | 3.1 |

TABLE 3A

Performance of OA/RA/LFV/HCV System Compared with that of Conventional Systems at Two Representative Operating Points

| | OA/RA/LFV/HCV | | CONVENTIONAL VAV | | CONVENTIONAL CAV | |
|---|---|---|---|---|---|---|
| Load Condition | A | B | A | B | A | B |
| Outside air - DBT/WBT(C) | 32/27 | 25/24.5 | 32/27 | 25/24.5 | 32/27 | 25/24.5 |
| Number of Students | 150 | 150 | 150 | 150 | 150 | 150 |
| Room Loads | | | | | | |
| Sensible - | | | | | | |
| People (kW) | 10.11 | 10.11 | 10.11 | 10.11 | 10.11 | 10.11 |
| Transmission (kW) | 7.10 | 1.26 | 7.10 | 1.26 | 7.10 | 1.26 |

TABLE 3A-continued

| Performance of OA/RA/LFV/HCV System Compared with that of Conventional Systems at Two Representative Operating Points | | | | | | |
|---|---|---|---|---|---|---|
| | OA/RA/LFV/HCV | | CONVENTIONAL VAV | | CONVENTIONAL CAV | |
| Load Condition | A | B | A | B | A | B |
| Lights (kW) | 1.98 | 1.98 | 1.98 | 1.98 | 1.98 | 1.98 |
| Equipment (kW) | 0.50 | 0.50 | 0.50 | 0.50 | 0.50 | 0.50 |
| Total Sensible (kW) | 16.69 | 13.85 | 16.69 | 13.85 | 16.69 | 13.85 |
| Latent - | | | | | | |
| People (kW) | 8.36 | 8.36 | 8.36 | 8.36 | 8.36 | 8.36 |
| Total Room (kW) | 28.05 | 22.21 | 28.05 | 22.21 | 28.05 | 22.21 |
| % Room Sensible Load | 100.00% | 70.34% | 100.00% | 70.34% | 100.00% | 70.34% |
| Room Sensible Heat Ratio | 0.702 | 0.624 | 0.702 | 0.624 | 0.702 | 0.624 |
| Coil Details | | | | | | |
| Refrig Cap (kW) | 56.38 | 34.61 | 56.40 | 33.20 | 56.40 | 38.40 |
| Chilled Water Quantity (lps) | 6.04 | 3.38 | 1.64 | 0.78 | 1.64 | 0.82 |
| Water Velocity (m/s) | 1.92 | 1.61 | 1.17 | 0.56 | 1.17 | 0.59 |
| Entering Water Temp (C.) | 6.50 | 6.50 | 6.50 | 6.50 | 6.50 | 6.50 |
| Water Temp Rise (C.) | 2.23 | 2.45 | 8.20 | 10.20 | 8.20 | 11.20 |
| Water Pressure Drop (kPa) | 33.97 | 20.09 | 16.28 | 4.49 | 16.28 | 4.88 |
| Outside Air (lps) | 600.00 | 414.16 | 600.00 | 414.16 | 600.00 | 600.00 |
| Outside Air (lps/person) | 4.00 | 2.76 | 4.00 | 2.76 | 4.00 | 4.00 |
| Total Air (lps) | 1693.28 | 1191.42 | 2002.18 | 1408.34 | 2002.18 | 2002.18 |
| Face Velocity (m/s) | 0.86 | 0.61 | 2.50 | 1.76 | 2.50 | 2.50 |
| Coil-off DBT (C.) | 13.09 | 13.57 | 14.40 | 15.00 | 14.40 | 16.80 |
| Coil-off DPT (C.) | 12.53 | 12.26 | 14.30 | 14.84 | 14.30 | 16.65 |
| Supply-Air DBT (C.) | 14.50 | 14.50 | 16.00 | 16.00 | 16.00 | 18.37 |

TABLE 3B

| Performance of OA/RA/LFV/HCV System Compared with that of Conventional Systems at two Representative Operating Points | | | | | | |
|---|---|---|---|---|---|---|
| | OA/RA/LFV/HCV | | CONVENTIONAL VAV | | CONVENTIONAL CAV | |
| Load Condition | A | B | A | B | A | B |
| Room Condition | | | | | | |
| Room DBT (C.) | 24.00 | 24.00 | 24.00 | 24.00 | 24.00 | 24.00 |
| Room DPT (C.) | 15.02 | 15.73 | 16.18 | 17.44 | 16.18 | 18.33 |
| Room Humidity Ratio (g/kg) | 10.66 | 11.17 | 11.50 | 12.48 | 11.50 | 13.21 |
| Room RH | 57.19% | 59.87% | 61.60% | 66.80% | 61.60% | 70.60% |
| Room DT | 9.50 | 9.50 | 8.00 | 8.00 | 8.00 | 5.63 |
| Power Consumption | | | | | | |
| Refrig. Power Cons. (kW) | 17.62 | 10.82 | 17.63 | 10.38 | 17.63 | 12.00 |
| Fan Dissipation (kW) | 0.04 | 0.01 | 0.55 | 0.22 | 0.55 | 0.53 |
| Pump Power (kW) | 0.26 | 0.08 | 0.03 | 0.00 | 0.03 | 0.01 |
| Total Power Cons. (kW) | 17.92 | 10.91 | 18.20 | 10.60 | 18.20 | 12.54 |

Notes:
1. OA/RA/LFV/HCV selection based on 3 row, 6 fpi, 914 mm high — Outside air section 772 mm wide; Return air section 1397 mm wide
2. Conventional selection based on 4 row, 12 fpi, 610 mm high × 1313 mm wide.
3. Refrigeration power consumption derived from refrigeration capacity using a coefficient of performance of 4.0 and a compressor efficiency of 0.8.
4. Load condition A represents peak load condition D represents lowest room sensible heat ratio.

TABLE 4

| CENTRAL O.A. HANDLING UNIT | | |
|---|---|---|
| Minimum Partload OA | Peak OA Unit Performance | Critical Part Load OA Unit Performance |
| edbt | 32.0° C. | 25.0° C. |
| edpt | 25.4° C. | 24.3° C. |
| e water temp | 6.7° C. | 6.7° C. |

TABLE 4-continued

| CENTRAL O.A. HANDLING UNIT | | |
|---|---|---|
| Minimum Partload OA | Peak OA Unit Performance | Critical Part Load OA Unit Performance |
| Std Air Vol Flow | 3,333 lps | 3,333 lps |
| water flow rate | 16.0 lps per row | 16.0 lps per row |
| height of face | 1.910 m | 1.910 m |

TABLE 4-continued

| CENTRAL O.A. HANDLING UNIT | | |
|---|---|---|
| Minimum Partload OA | Peak OA Unit Performance | Critical Part Load OA Unit Performance |
| length of face | 3,790 m | 3,700 m |
| rows | 4 | 4 |
| no of tubes high | 50 | 50 |
| coil face area | 7.067 $m^2$ | 7.067 $m^2$ |
| Std face velocity | 0.47 m/s | 0.47 m/s |
| actual air vol flow | 3.512 $m^3/s$ | 3.428 $m^3/s$ |
| actual face velocity | 0.50 m/s | 0.49 m/s |
| water velocity | 1.83 m/s | 1.83 m/s |
| water temp rise | 0.83° C. | 0.67° C. |
| entering enthalpy | 84.63 kJ/kg | 74.03 kJ/kg |
| leaving enthalpy | 28.53 kJ/kg | 27.00 kJ/kg |
| ldbt | 9.67° C. | 8.93° C. |
| ldpt | 9.60° C. | 8.93° C. |
| cooling kW capacity | 221.73 kW | 180.22 kW |

NOTE:
Design data for the Central O.A. Handling Unit supplying treated ventilation air for mixing with air from the Return Air Handling Units serving 10 storeys of an hypothetical Singapore office building.

and humidity of air in at least one space, with respect to air outside of said at least one space and heat and moisture sources within said at least one space, to a set temperature and humidity, comprising:

an outside air heat exchanger through which said outside air passes before passing into said at least one space, return air treatment means comprising at least one return air heat exchanger for each said space through which air from said space passes before returning to said space, coolant flow conduits connecting said outside air and return air heat exchangers, the configuration of said conduits arranged so that coolant is directed first through said outside air heat exchanger and subsequently through said at least one return air heat exchanger, pump means to circulate coolant through said outside and return air heat exchangers, control means for controlling the flow rate of coolant through said return air heat exchangers, air flow means to create both air flow of outside air through said outside air heat exchanger into said at least one space and to create air flow of air from within said at least one space through said return air heat exchanger

TABLE 5

| STANDARD & PRESTIGE SPLIT SYSTEM OF INVENTION COMPARED | | | | |
|---|---|---|---|---|
| | "Prestige" Air Conditioning System Return Air Coil - 2 stages | | "Standard" Air Conditioning System Return Air Coil - Single Stage | |
| Performance Data | Peak Load Stage 1 | Part Load Stage 2 | Peak Load Fixed Size | Part Load Fixed Size |
| Room RH % | 48.6 | 49.1 | 49.5 | 54.0 |
| Water Temp. Rise | 4.5° C. (8.1° F.) | 2.0° C. (3.6° F.) | 3.2° C. (5.8° F.) | 7.6° C. (13.7° F.) |
| Chilled Water | 4.6 Lps (9.8 cfm) | 4.7 Lps (10 cfm) | 6.5 Lps (13.8 cfm) | 1.2 Lps (2.5 cfm) |
| Face Velocity | 1.68 m/s (5.51 ft/s) | 0.77 m/s (2.53 ft/s) | 2.24 m/s (7.35 ft/s) | 1.03 m/s (3.38 ft/s) |
| Room Sensible Load | 77.4 kW (264164 Btu/h) | 39.0 kW (133106 Btu/h) | 77.4 kW (264164 Btu/h) | 39.0 kW (133106 Btu/h) |

TABLE 6

| ANNUAL RUNNING COST OF COMPARATIVE ANALYSIS OF ADJACENT LFV/HCV WITH CONVENTIONAL SYSTEMS | | | |
|---|---|---|---|
| | OA/RA/LFV/HCV VAV | CONVENTIONAL VAV | CONVENTIONAL CAV |
| HIGH RANGE: kW-Hrs Ambient 30.5° C.–33.0° C., 150 Students | 20,769 (17.92 kW × 1,159 Hrs) | 26,877 (23.19 kW × 1,159 Hrs) | 26,877 (23.19 kW × 1,159 Hrs) |
| MID RANGE: kW-Hrs Ambient 28.0° C.–30.5° C., 100 Students | 41,024 (12.78 kW × 3,210 Hrs) | 54,987 (17.3 kW × 3,210 Hrs) | 80,186 (24.98 kW × 3,210 Hrs) |
| LOW RANGE: kW-Hrs Ambient 24.5° C.–28.0° C., 100 Students | 22,439 (9.2 kW × 2,439 Hrs) | 33,829 (13.87 kW × 2,438 Hrs) | 63,170 (25.90 kW × 2,439 Hrs) |
| TOTAL OF ABOVE RANGES: kW-Hrs (covers 6,808 hours) | 84,232 | 115,693 | 170,233 |
| CORRECTED TO 2,000 Hours Annually: kW-Hrs (40 Hrs/wk × 50 wks) | 24,745 | 33,987 | 50,010 |
| ANNUAL RUNNING COST FOR LECTURE THEATRE NO. 1 - $ | 2,969 | 4,078 | 6,001 |
| ANNUAL RUNNING COST FOR 26 MAJOR LECTURE THEATRES - $ | 77,194 | 106,028 | 156,026 |
| ADDITIONAL RUNNING COST OF CONVENTIONAL SYSTEMS OVER OA/RA/LFV/HCV - % | — | 37.3 | 102.0 |

The claims defining the invention are as follows:

1. Air conditioning means for controlling the temperature connected to said space before returning back into said space, and air flow directing means which causes air from said outside and return air heat; exchangers to mix before flowing into said at least one space, said outside air flow equalling at least the ventilation air requirements for said at least one space, the coolant flow through the outside air heat exchanger being such that the coolant entering said return air heat exchanger after exiting said Outside air heat exchanger is at the temperature required to cool the incoming return air to a temperature and humidity such that when the air from said outside and return air heat exchangers are mixed and supplied to said at least one space, the air in said at least one space is at said set temperature and humidity.

2. Air conditioning means according to claim 1 wherein said control means of coolant flow rate also independently controls the flow rate of coolant through said outside air heat exchanger, the coolant flow through said outside air heat exchanger being varied dependent on the temperature of the outside air.

3. Air conditioning means according to claim 1 wherein said return air treatment means comprises a plurality of said return air heat exchangers, said air flow ducting means directing air flow from said outside air heat exchanger to each of said return air heat exchangers.

4. Air conditioning means according to claim 3 wherein said coolant flow conduits for said return air heat exchangers are arranged in a parallel configuration.

5. Air conditioning means according to claim 4 further comprising coolant throttling means between said outside and return air heat exchangers for controlling distribution of coolant flow between said plurality of return air heat exchangers.

6. Air conditioning means according to claim 1 wherein said outside air is cooled by said outside air heat exchanger to a temperature below that required to achieve said set temperature and humidity in said at least one space to allow for heat gain prior to mixing with said return air leaving said return air heat exchanger.

7. Air conditioning means according to claim 1 further comprising a bypass conduit and bypass control valve on said outside air heat exchanger and on said return air treatment means, said bypass conduit providing a parallel coolant flow path so that coolant may bypass said outside air heat exchanger and said return air treatment means, said bypass control valve controlling coolant flow rate through said outside air heat exchangers and said return air treatment means.

8. Air conditioning means according to either claim 6 or 7 further comprising a pressure responsive valve in said return air treatment bypass conduit and said pump means comprising a variable flow rate pump, said pressure responsive valve maintaining a set pressure drop across said return air treatment means when the flow of coolant from said variable flow rate pump is reduced.

9. Air conditioning means according to claim 1 wherein said coolant temperature and flow rate through said outside air heat exchanger is such that the outside air leaving said outside air heat exchanger is close to saturation at a dew point temperature that is below the dew point of the air within said at least one space.

10. A method of air conditioning for controlling the temperature and humidity of air in at least one space, with respect to air outside of said at least one space and heat and moisture sources within said at least one space, to a set temperature and humidity comprising:

(a) passing said outside air through an outside air heat exchanger before passing said outside air into said space, (b) passing air from within said space through a return air treatment means comprising at least one return air heat exchanger before returning said air to said at least one space, (c) directing the air flow through said outside and return air heat exchangers so that air flow exiting said heat exchangers mixes prior to entering said at least one space, said outside air flow equalling at least the ventilation requirements for said at least one space, (d) providing coolant flow to said outside air heat exchanger and said return air treatment means such that coolant is first directed through said outside air heat exchanger, and subsequently through said at least one return air heat exchanger, (e) controlling the flow rate of coolant through said return air heat exchangers the flow rate of the coolant through said outside air heat exchanger such that the coolant leaving said outside air heat exchanger and entering said return air heat exchangers is at a temperature required to cool the incoming return air to a temperature and humidity such that when the air from said outside and return air heat exchangers are mixed and supplied to said at least one space, the air in said at least one space is at said set temperature and humidity.

11. A method of air conditioning according to claim 10 wherein said coolant flow is controlled independently through said outside air heat exchanger at a flow rate that is dependent on the temperature of the outside air.

12. A method of air conditioning according to claim 10 wherein said return air treatment means comprises a plurality of said return air heat exchangers, and said air flow is directed from said outside air heat exchanger to the outlet of each of said return air heat exchangers.

13. A method of air conditioning according to claim 12 further comprising the throttling of the coolant flow rate between said plurality of return air heat exchangers.

14. A method of air conditioning according to claims 10 wherein said coolant temperature and flow rate through said outside air heat exchanger is such that the outside air leaving said outside air heat exchanger is close to saturation at a dew point temperature that is below the dew point of the air within said at least one space.

15. A method of air conditioning according to claim 10 wherein said coolant flow is varied independently through both said outside air heat exchanger and said return air treatment means.

16. A method of air conditioning according to claim 15 wherein said coolant flow is varied by a variable flow rate pump.

17. A method of air conditioning according to claim 15 wherein said coolant flow is varied by providing one or more bypass conduits that bypasses the flow of coolant around said outside and return air heat exchangers and said return air treatment means.

18. A method of air conditioning according to claim 10 wherein the entry temperature of said coolant to said outside air heat exchanger is not greater than 11 degrees Celsius, and controlling said coolant flow rate through said return air treatment means so that the temperature rise of said coolant upon passing through any one of said return air heat exchangers does not exceed 10 degrees Celsius.

19. A method of air conditioning according to claim 10 wherein the flow rate of said coolant through said outside air heat exchanger is varied, dependent on the temperature of said outside air, to cool said outside air sufficiently such that moisture content of said cooled outside air when mixed with said return air will result in a relative humidity in said space that does not exceed said set humidity.

* * * * *